US006837161B2

(12) United States Patent
Kosuge et al.

(10) Patent No.: US 6,837,161 B2
(45) Date of Patent: Jan. 4, 2005

(54) INK REMOVAL METHOD FOR PRINTING PRESS

(75) Inventors: Akira Kosuge, Higashikatsushika-gun (JP); Kazunori Saito, Higashikatsushika-gun (JP)

(73) Assignee: Komori Corporation, Tokyo (JP)

( * ) Notice: Subject to any disclaimer, the term of this patent is extended or adjusted under 35 U.S.C. 154(b) by 617 days.

(21) Appl. No.: 09/858,599

(22) Filed: May 17, 2001

(65) Prior Publication Data

US 2001/0042481 A1 Nov. 22, 2001

(30) Foreign Application Priority Data

May 17, 2000 (JP) ..... 2000-144889

(51) Int. Cl.[7] ..... B41F 31/00; B41F 35/00; B41L 25/00

(52) U.S. Cl. ..... 101/483; 101/148; 101/351.1; 101/425

(58) Field of Search ..... 101/351.1, 352.1, 101/352.04, 143, 144, 145, 147, 148, 218, 247, 450.1, 451, 483, 485

(56) References Cited

U.S. PATENT DOCUMENTS 3,701,316 A * 10/1972 Sylvester et al. ..... 101/148
3,842,735 A * 10/1974 Southam et al. ..... 101/145
4,724,764 A * 2/1988 MacPhee et al. ..... 101/451
5,174,210 A * 12/1992 Rodi et al. ..... 101/492
5,676,057 A * 10/1997 Hummel et al. ..... 101/349.1
5,992,317 A * 11/1999 Hummel et al. ..... 101/148

FOREIGN PATENT DOCUMENTS

JP 7-171943 A 7/1995

* cited by examiner

*Primary Examiner*—Andrew H. Hirshfeld
*Assistant Examiner*—Leo T. Hinze
(74) *Attorney, Agent, or Firm*—Birch, Stewart, Kolasch & Birch, LLP

(57) ABSTRACT

An ink removal method for a printing press includes an ink removal step of bringing ink form rollers and a dampening form roller into a throw-on state relative to a plate cylinder, and bringing the dampening form roller into a throw-off state relative to a ductor roller of a dampening unit. The ink removal method has high general purpose properties, and can remove ink from the dampening form roller with high accuracy by simple means, i.e., changing throw-on and throw-off timings for existing rollers without using a rider roller or the like.

16 Claims, 3 Drawing Sheets

INK REMOVAL METHOD FOR PRINTING PRESS

The entire disclosure of Japanese Patent Application No. 2000-144889 filed on May 17, 2000 including specification, claims, drawings, and abstract is incorporated herein by reference in its entirety.

BACKGROUND OF THE INVENTION

1. Field of the Invention

This invention relates to an ink removal method for a rotary offset press, etc.

2. Description of the Related Art

In a lithographic press such as a rotary offset press, an image is formed on a surface of a plate mounted on a plate cylinder by ink and water supplied by an inking device and a dampening unit, respectively. This image is transferred to paper directly or via a blanket cylinder, whereby printing is performed. The inking device is generally designed to transfer ink, stored in an ink fountain, from an ink fountain roller to an ink ductor roller, an ink distribution roller, an ink oscillating roller, and ink form rollers in this order, thereby supplying ink to the plate surface. On the other hand, the dampening unit has a water pan storing water, a water fountain roller rotating while being immersed in the water in the water pan, a dampening form roller rotating with its circumferential surface in contact with the plate surface, and a ductor roller (metering roller) disposed between the water fountain roller and the dampening form roller, and having a circumferential surface in contact with both of these rollers. Water taken up by the water fountain roller is continuously transferred to the dampening form roller via the ductor roller, and fed to the plate surface.

As printing proceeds in the above-described lithographic press, the phenomenon that ink emulsified upon supply of water from the dampening unit clings to the dampening form roller occurs. If this phenomenon progresses, the supply of water from the dampening unit is not performed smoothly and causes smudging of a print, such as scumming or tinting. Thus, it is necessary to remove ink from the dampening form roller at a predetermined time.

Japanese Unexamined Patent Publication No. 1995-171943 discloses a configuration, in which a rider roller acts as a bridge between a dampening form roller and ink form rollers. This configuration can make the water film thickness of the dampening form roller constant, thereby preventing ink from clinging to the dampening form roller. However, the number of rollers arranged in a small installation space increases further. Thus, this configuration cannot be applied widely to lithographic presses, and lacks general purpose properties.

SUMMARY OF THE INVENTION

The present invention has been accomplished in consideration of the above problems with the earlier technologies. It is an object of the present invention to provide an ink removal method for a printing press, which has high general purpose properties and which can remove ink from a dampening form roller at a high precision by simple means, i.e., changing throw-on and throw-off timings for existing rollers without using a rider roller or the like.

An ink removal method for a printing press according to the present invention, which attains the above object, has the following features:

(1) The ink removal method includes the ink removal step of bringing ink form rollers and a dampening form roller into a throw-on state relative to a plate cylinder, and bringing the dampening form roller into a throw-off state relative to a roller group of a dampening unit. Thus, ink can be removed with high precision from the dampening form roller, etc. by simple means. Furthermore, it is sufficient to work on throw-on and throw-off timings for rollers. Hence, the ink removal method with high general purpose properties can be realized without imposing restrictions on roller arrangement or space.

(2) In the ink removal method, the ink removal step is performed in a printing cylinder OFF state in which a printing cylinder is not in contact with the plate cylinder, thus making printing impossible, and in an ink ductor roller OFF state in which ink cannot be supplied to a plate surface of the plate cylinder.

(3) The ink removal method also includes the ink regeneration step executed after the ink removal step, the ink regeneration step including the step of bringing the ink form rollers and the dampening form roller into a throw-off state relative to the plate cylinder.

(4) The ink removal method also includes the all throw-off step executed prior to the ink removal step, the all throw-off step including the step of bringing the ink form rollers and the dampening form roller into a throw-off state relative to the plate cylinder.

(5) In the ink removal method, the ink regeneration step is executed in a printing cylinder OFF state in which a printing cylinder is not in contact with the plate cylinder, thus making printing impossible, and in an ink ductor roller OFF state in which ink cannot be supplied to a plate surface of the plate cylinder.

(6) In the ink removal method, the all throw-off step is executed in a printing cylinder OFF state in which a printing cylinder is not in contact with the plate cylinder, thus making printing impossible, and in an ink ductor roller OFF state in which ink cannot be supplied to a plate surface of the plate cylinder.

(7) The ink removal method further includes the plate surface regeneration step executed after the ink regeneration step, the plate surface regeneration step includes the step of bringing the dampening form roller into a throw-on state relative to the roller group of the dampening unit and the plate cylinder, and then bringing the ink form rollers into a throw-on state relative to the plate cylinder.

(8) In the ink removal method, the plate surface regeneration step is executed in a printing cylinder OFF state in which a printing cylinder is not in contact with the plate cylinder, thus making printing impossible, and in an ink ductor roller OFF state in which ink cannot be supplied to a plate surface of the plate cylinder.

(9) The ink removal method further includes the printing make-ready step executed after the plate surface regeneration step, the printing make-ready step includes the step of bringing the dampening form roller into a throw-on state relative to the roller group of the dampening unit and the plate cylinder, then bringing the ink form rollers into a throw-on state relative to the plate cylinder, then contacting a printing cylinder with the plate cylinder to provide a printing cylinder ON state in which printing is possible, and then providing an ink ductor roller ON state in which ink can be supplied to a plate surface of the plate cylinder.

(10) The ink removal method of (9), the dampening form roller is brought into the throw-on state relative to the roller group of the dampening unit and the plate cylinder, and then bringing the ink form rollers into the throw-on state relative to the plate cylinder, in a printing cylinder OFF state in which the printing cylinder is not in contact with the plate cylinder, thus making printing impossible, and in an ink ductor roller OFF state in which ink cannot be supplied to the plate surface of the plate cylinder.

(11) The ink removal method further includes the printing make-ready step executed after the ink regeneration step, the printing make-ready step includes the step of bringing the dampening form roller into a throw-on state relative to the roller group of the dampening unit and the plate cylinder, then bringing the ink form rollers into a throw-on state relative to the plate cylinder, then contacting a printing cylinder with the plate cylinder to provide a printing cylinder ON state in which printing is possible, and then providing an ink ductor roller ON state in which ink can be supplied to a plate surface of the plate cylinder.

(12) In the ink removal method of (11), the dampening form roller is brought into the throw-on state relative to the roller group of the dampening unit and the plate cylinder, and then bringing the ink form rollers into the throw-on state relative to the plate cylinder, in a printing cylinder OFF state in which the printing cylinder is out of contact with the plate cylinder, thus making printing impossible, and in an ink ductor roller OFF state in which ink cannot be supplied to the plate surface of the plate cylinder.

(13) The ink removal method further includes the step of printing after the ink regeneration step, and then executing the ink reduction step when stopping the printing press, the ink reduction step includes the step of bringing the ink form rollers into a throw-off state relative to the plate cylinder before separating the dampening form roller from the plate cylinder.

(14) In the ink removal method of (13), the ink form rollers are brought into a throw-off state relative to the plate cylinder in a printing cylinder ON state in which a printing cylinder is in contact with the plate cylinder, thus making printing possible, and in an ink ductor roller OFF state in which ink cannot be supplied to a plate surface of the plate cylinder, before separating the dampening form roller from the plate cylinder in a printing cylinder OFF state in which the printing cylinder is not in contact with the plate cylinder, thus making printing impossible, and in the ink ductor roller OFF state in which ink cannot be supplied to the plate surface of the plate cylinder.

(15) The ink removal method is characterized by performing printing after the plate surface regeneration step, and then performing an ink reduction step when stopping the printing press, the ink reduction step comprising bringing the ink form rollers into a throw-off state relative to the plate cylinder before separating the dampening form roller from the plate cylinder.

(16) In ink removal method of (15), the ink form rollers are brought into a throw-off state relative to the plate cylinder in a printing cylinder ON state in which a printing cylinder is in contact with the plate cylinder, thus making printing possible, and in an ink ductor roller OFF state in which ink cannot be supplied to a plate surface of the plate cylinder, before separating the dampening form roller from the plate cylinder in a printing cylinder OFF state in which the printing cylinder is out of contact with the plate cylinder, thus making printing impossible, and in the ink ductor roller OFF state in which ink cannot be supplied to the plate surface of the plate cylinder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of an ink removal method for a printing press according to the present invention will now be described in detail with reference to the accompanying drawings, which in no way limit the invention.

Figure 1:
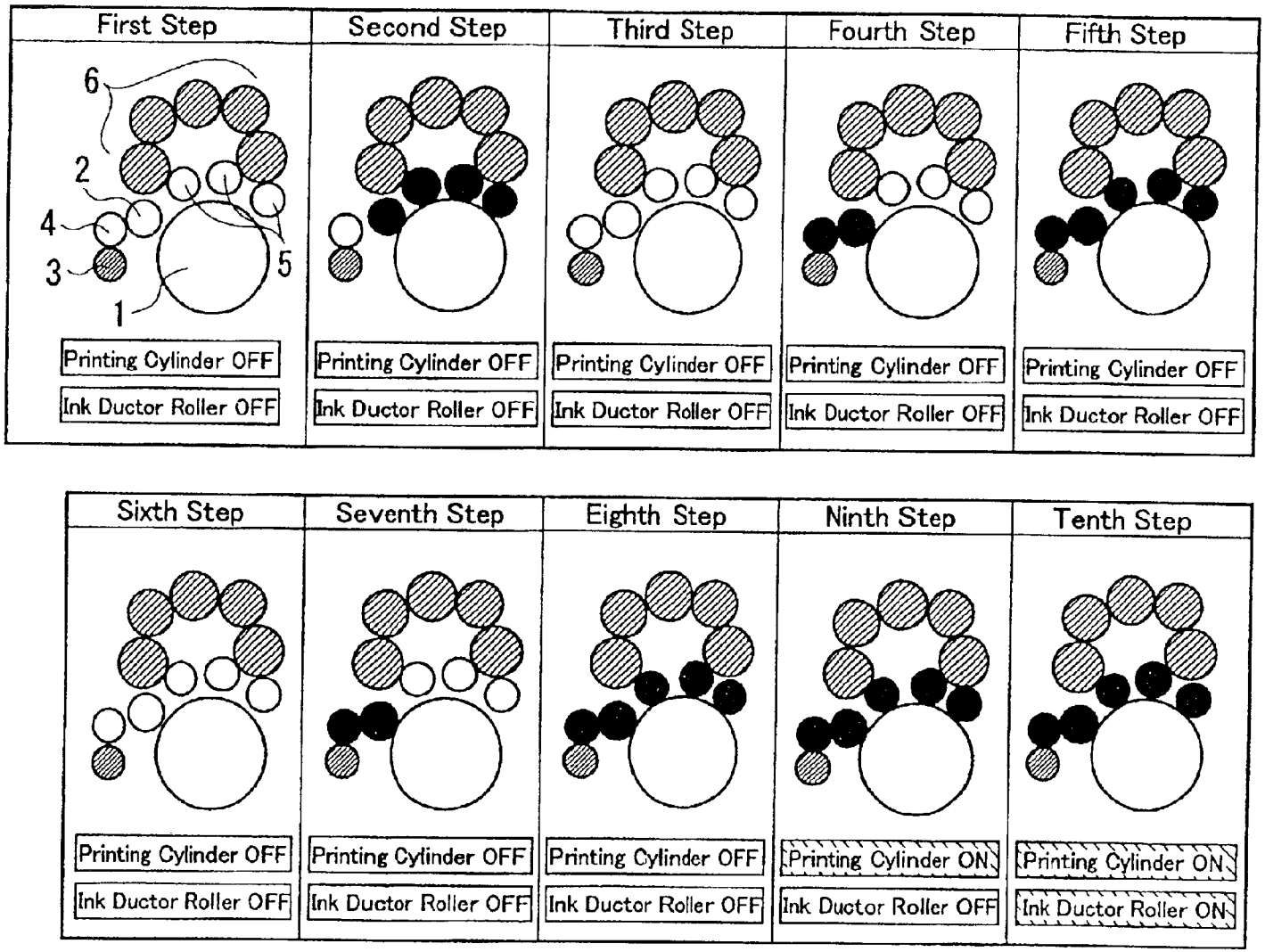
FIG. 1 is a process chart of a mode of ink removal before start of printing in a rotary offset press showing an embodiment of the present invention.
Figure 2:
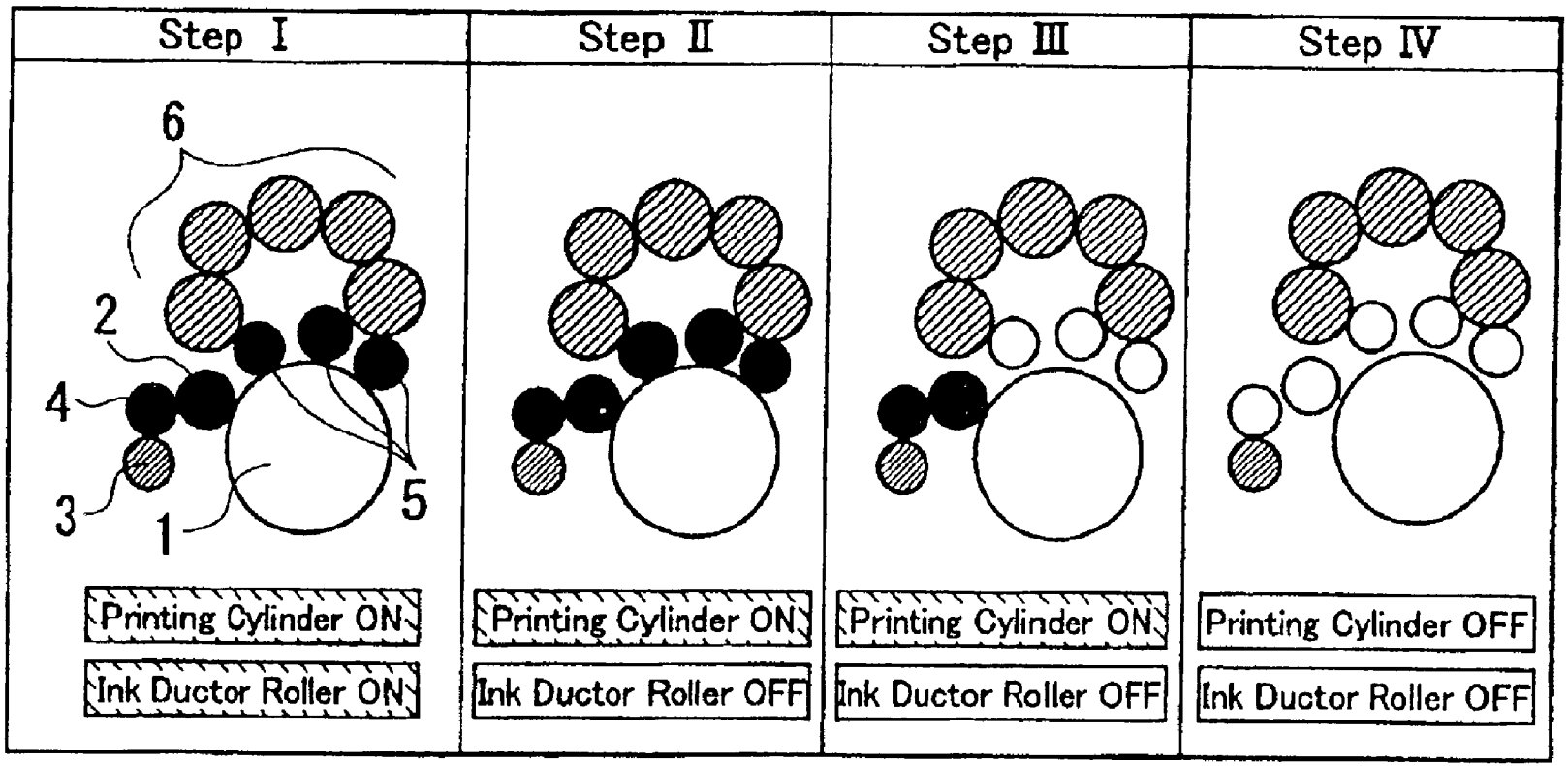
FIG. 2 is a process chart of a mode of ink removal after completion of printing (non-printing ink reduction) in the rotary offset press.
Figure 3:
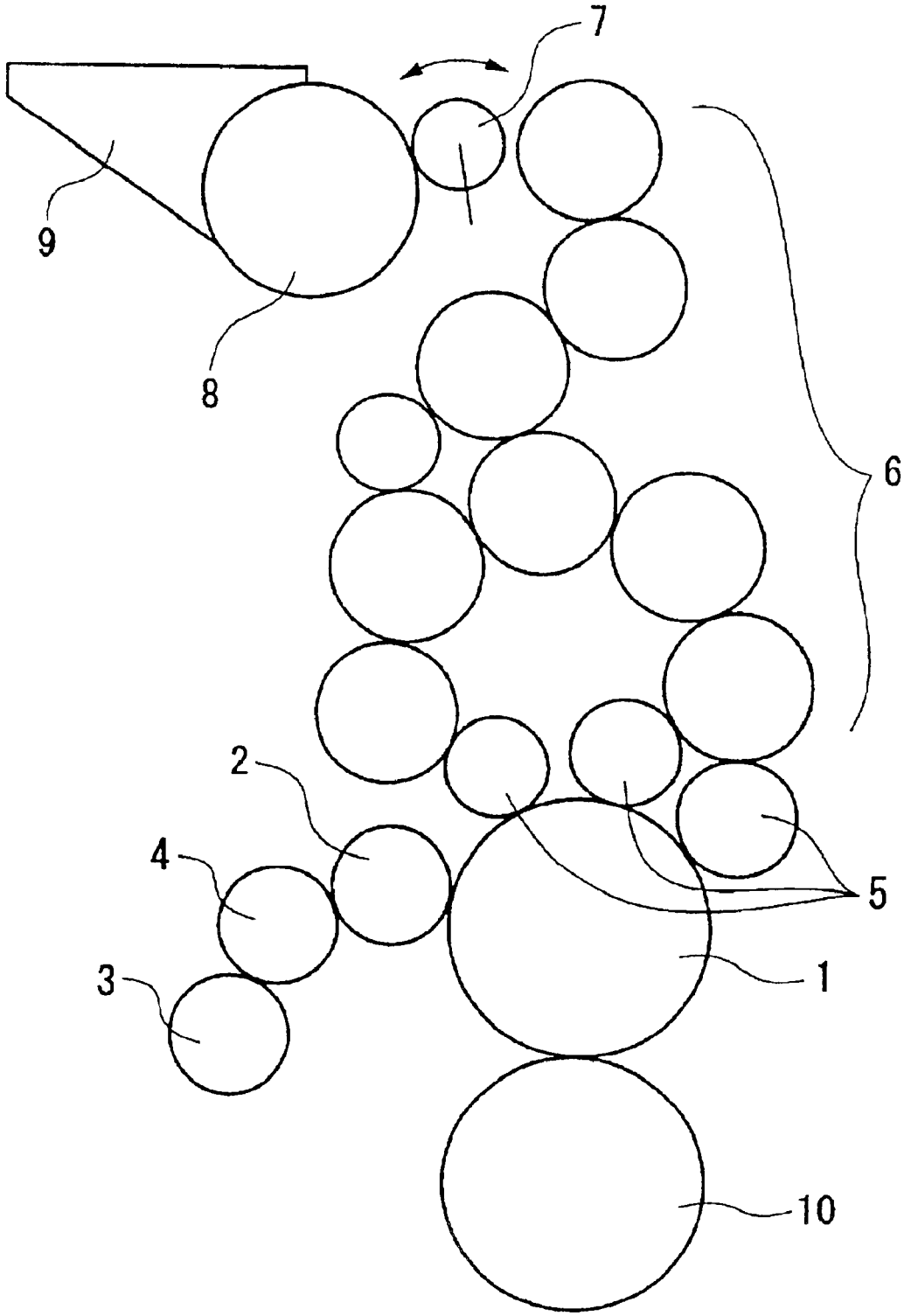
FIG. 3 is an explanatory drawing of an inking device of the rotary offset press.

FIG. 1 is a process chart of a mode of ink removal before start of printing in a rotary offset press showing an embodiment of the present invention. FIG. 2 is a process chart of a mode of ink removal after completion of printing (non-printing ink reduction) in the rotary offset press. FIG. 3 is an explanatory drawing of an inking device of the rotary offset press.

As shown in the drawings, an ink removal mode (first to fifth steps), according to the present invention, is set before an automatic operation mode (sixth to tenth steps) of a rotary offset press for simultaneously printing a face side and a back side of a traveling web by a printing unit having a pair of blanket cylinders 10 to contact each other (one of the blanket cylinders 10 is not shown), and a pair of plate cylinders 1 to contact the pair of blanket cylinders 10 (one of the plate cylinders 1 is not shown). In the drawings, numeral 1 denotes the plate cylinder in contact with the blanket cylinder 10 as a printing cylinder. Numeral 2 denotes a dampening form roller, constituting a dampening unit, that can supply water transferred from a water pan (not shown) via a water fountain roller 3 and a ductor roller (metering roller) 4, to the surface of a plate (hereinafter referred to as a plate surface) mounted on the circumferential surface of the plate cylinder 1. Numeral 5 denotes an ink form roller constituting an inking device. The ink form rollers 5 can supply ink, which has been transferred from an ink fountain 9 via an ink fountain roller 8, an ink ductor roller 7, and an ink roller group 6 including an ink distribution roller and an ink oscillating roller, to the plate surface.

The actions of the dampening form roller 2 include a throw-on action of contacting only the plate cylinder 1 (ON action), a throw-on action of contacting both the plate cylinder 1 and the ductor roller 4 (ON action), a throw-off action of departing from the plate cylinder 1 while contacting the ductor roller 4 (OFF action), and a throw-off action of departing from both the plate cylinder land the ductor roller 4 (OFF action). The actions of the ink form rollers 5 include a throw-on action of contacting the plate cylinder 1 (ON action), and a throw-off action of departing from the plate cylinder 1 (OFF action). Switching among these throw-on and throw-off actions is performed by a throw-on/throw-off mechanism comprising a lever, an air cylinder, etc. (not shown).

In the drawings, "Printing Cylinder OFF" refers to a state in which one of the blanket cylinders 10 is separated from the plate cylinder 1, the other blanket cylinder (not shown) is also separated from the plate cylinder (not shown), and the pair of blanket cylinders 10 are separated from each other, namely, a state in which printing is impossible. "Printing Cylinder ON" refers to a state in which one of the blanket cylinders 10 is in contact the plate cylinder 1, the other blanket cylinder (not shown) is also in contact with the plate cylinder (not shown), and the pair of blanket cylinders 10 are in contact with each other, namely, a state in which printing is possible. Similarly, "Ink Ductor Roller OFF" refers to a state in which the ink ductor roller 7 is separated from the ink roller group 6 located downstream (the ink ductor roller 7 being in contact with the ink fountain roller 8), thus making ink supply to the plate surface impossible. "Ink Ductor Roller ON" refers to a state in which the ink ductor roller 7 reciprocates between the ink fountain roller 8 and the most upstream roller of the ink roller group 6, thus making ink supply to the plate surface possible.

Next, the aforementioned ink removal mode will be described in the sequence of steps according to the process chart. In the first step (all throw-off step), the dampening form roller 2 is contacted with (or may be separated from) the ductor roller 4, and the ink form rollers 5 and the dampening form roller 2 are separated from the plate cylinder 1, to provide an all throw-off state, in the "Printing Cylinder OFF" and "Ink Ductor Roller OFF" states. The printing press is driven from this all throw-off state. In this condition, an image area and a non-image area are formed on the plate surface, but emulsified ink clings to the dampening form roller 2.

Then, in the second step (ink removal step), the dampening form roller 2 is separated from the ductor roller 4, and the ink form rollers 5 and the dampening form roller 2 are brought into a throw-on state relative to the plate cylinder 1, similar to the "Printing Cylinder OFF" and "Ink Ductor Roller OFF" states. As a result, ink clinging to (piled on) the dampening form roller 2 is cut off from water, and increases in stickiness. Thus, the ink is transferred to the plate surface of the plate cylinder 1, and further sucked up by the ink form rollers 5. In this manner, ink is removed from the dampening form roller 2. In this condition, the plate surface is similarly cut off from water, and thus is in a solid state free from an image area or a non-image area.

Then, in the third step (ink regeneration step), the dampening form roller 2 is separated from (or may be in contact with) the ductor roller 4, and the ink form rollers 5 and the dampening form roller 2 are brought into a throw-off state relative to the plate cylinder 1, similar to the "Printing Cylinder OFF" and "Ink Ductor Roller OFF" states. As a result, emulsified ink stagnating on a downstream side of the ink roller group 6, including the ink form rollers 5, is mixed with raw ink present on an upstream side of the ink roller group 6. Thus, water is extracted to regenerate the ink. In this condition, the plate surface is still cut off from water, and thus is in a solid state free from an image area or a non-image area.

In the foregoing manner, ink is removed from the dampening form roller 2, and ink stagnant in the ink roller group 6 is regenerated. If the ink is emulsified highly (seriously), printing started from this state may result in web jamming and tearing, since the plate surface is in a solid state. According to the present embodiment, therefore, the image area and the non-image area of the plate surface are promptly regenerated in the forth and fifth steps (plate surface regeneration step). (If the ink is emulsified to a low degree, the fourth and fifth steps may be omitted.) That is, in the fourth step, the dampening form roller 2 is contacted with the ductor roller 4, and the dampening form roller 2 is also brought into contact with the plate cylinder 1, in the "Printing Cylinder OFF" and "Ink Ductor Roller OFF" states, whereby water is supplied to the plate surface to clean the plate surface. Then, in the fifth step, the ink form rollers 5 are brought into contact with the plate cylinder 1, in the "Printing Cylinder OFF" and "Ink Ductor Roller OFF" states. Thus, surplus ink in a portion corresponding to a non-image area is sucked up by the ink form rollers 5, and ink is supplied to a portion corresponding to an image area to form an image area and a non-image area on the plate surface.

Then, the printing press moves into a conventional automatic operation mode (printing make-ready step). That is, in the sixth step in an all throw-off state, the dampening form roller 2 is separated from (or may be in contact with) the ductor roller 4, and the ink form rollers 5 and the dampening form roller 2 are separated from the plate cylinder 1, in the "Printing Cylinder OFF" and "Ink Ductor Roller OFF" states. Then follows the seventh step of contacting the dampening form roller 2 with the ductor roller 4, and contacting the dampening form roller 2 with the plate cylinder 1, in the "Printing Cylinder OFF" and "Ink Ductor Roller OFF" states. Then follows the eighth step of contacting the ink form rollers 5 with the plate cylinder 1, in the "Printing Cylinder OFF" and "Ink Ductor Roller OFF" states. Subsequently, the printing press proceeds to the ninth step of providing the "Printing Cylinder ON" state, followed by the tenth step of providing the "Ink Ductor Roller ON" state.

In the present embodiment, moreover, printing is performed after the sixth step (or the third step), whereafter the printing press is reduced in speed and stopped. At this time, the step of separating the ink form rollers 5 from the plate cylinder 1 is provided prior to the step of separating the dampening form roller 2 from the ductor roller 4 and the plate cylinder 1, as shown in FIG. 2. That is, in Step I, the printing press begins to reduce speed and stops, in the "Printing Cylinder ON" and "Ink Ductor Roller ON" states, and in a state in which the dampening form roller 2 contacts the ductor roller 4, and the dampening form roller 2 and the ink form rollers 5 contact the plate cylinder 1. From Step I, the printing press proceeds to Step II of producing the "Ink Ductor Roller OFF" state to decrease ink, which has stagnated in the ink roller group 6 including the ink form rollers 5, in a non-printing manner. Then, the printing press moves into Step III of separating the ink form rollers 5 from the plate cylinder 1, in the "Printing Cylinder ON" and "Ink Ductor Roller OFF" states, to decrease ink, which has stagnated on the dampening form roller 2 and the plate surface, in a non-printing manner. Then, the printing press proceeds to Step IV in an all throw-off state which comprises separating the dampening form roller 2 from the ductor roller 4 and the plate cylinder 1, in the "Printing Cylinder OFF" and "Ink Ductor Roller OFF" states. (The dampening form roller 2 and the ductor roller 4 may be in contact with each other.) This mode of ink removal after completion of printing (an ink reduction step) can shorten the time taken for the aforementioned mode of ink removal before start of printing. Where necessary, the mode of ink removal after completion of printing (the ink reduction step) may be omitted, and a conventional mode of speed reduction and stoppage may be carried out. The ink reduction step refers to a step in which ink in the ink fountain 9 is not supplied to the ink roller group 6 including the ink form rollers 5 (the ink ductor roller 7 is in the OFF state), while ink in the ink roller group and ink on the printing plate of the plate cylinder are transferred to a material to be printed, such as a web or a sheet, (the printing cylinder is in the ON state), whereby the ink in the ink roller group and the ink on the printing plate of the plate cylinder are reduced.

In the present embodiment, as described above, ink can be removed with high accuracy from the dampening form roller 2 and the plate cylinder 1 by simple means, i.e., changing throw-on and throw-off timings for existing rollers, such as the dampening form roller 2 and ink form rollers 5, without using a rider roller or the like. Furthermore, ink, which has stagnated in the ink roller group 6 including the ink form rollers 5 after printing, can be regenerated to improve printing quality. Besides, the present invention only works on throw-on and throw-off timings for the dampening form roller 2 and the ink form rollers 5. Thus, the invention can realize an ink removal method with high general purpose properties without imposing restrictions on roller arrangement or space in a printing press.

While the present invention has been described in the foregoing fashion, it is to be understood that the invention is not limited thereby, but may be varied in many other ways. For example, the number of rollers in the dampening unit can be changed. Moreover, the present invention can be applied to a printing press in which an impression cylinder as a printing cylinder contacts the plate cylinder 1. Such variations are not to be regarded as a departure from the spirit and scope of the invention, and all such modifications as would be obvious to one skilled in the art are intended to be included within the scope of the appended claims.

What is claimed is:

1. An ink removal method for a printing press, comprising:

an ink removal step including, bringing ink form rollers and a dampening form roller into a throw-on state relative to a plate cylinder, and bringing said dampening form roller into a throw-off state relative to a roller group of a dampening unit, wherein said ink removal step is executed in a printing cylinder OFF state in which a printing cylinder is out of contact with said plate cylinder, thus making printing impossible, and in an ink ductor roller OFF state in which ink cannot be supplied to a plate surface of said plate cylinder.

2. An ink removal method for a printing press, comprising:

an ink removal step including, bringing ink form rollers and a dampening form roller into a throw-on state relative to a plate cylinder, and bringing said dampening form roller into a throw-off state relative to a roller group of a dampening unit; and an ink regeneration step executed after said ink removal step, said ink regeneration step including, bringing said ink form rollers and said dampening form roller into a throw-off state relative to said plate cylinder.

3. The ink removal method for a printing press as claimed in claim 2, further comprising:

an all throw-off step executed prior to said ink removal step, said all throw-off step including, bringing said ink form rollers and said dampening form roller into a throw-off state relative to said plate cylinder.

4. The ink removal method for a printing press as claimed in claim 3, wherein said all throw-off step is executed in a printing cylinder OFF state in which a printing cylinder is out of contact with said plate cylinder, thus making printing impossible, and in an ink ductor roller OFF state in which ink cannot be supplied to a plate surface of said plate cylinder.

5. The ink removal method for a printing press as claimed in claim 2, wherein said ink regeneration step is executed in a printing cylinder OFF state in which a printing cylinder is out of contact with said plate cylinder, thus making printing impossible, and in an ink ductor roller OFF state in which ink cannot be supplied to a plate surface of said plate cylinder.

6. The ink removal method for a printing press as claimed in claim 2, further comprising:

a plate surface regeneration step executed after said ink regeneration step, said plate surface regeneration step including, bringing said dampening form roller into a throw-on state relative to said roller group of said dampening unit and said plate cylinder; and bringing said ink form rollers into a throw-on state relative to said plate cylinder.

7. The ink removal method for a printing press as claimed in claim 6, further comprising:

printing after said plate surface regeneration step; and reducing ink when stopping the printing press, wherein ink reduction step includes bringing said ink form rollers into a throw-off state relative to said plate cylinder before separating said dampening form roller from said plate cylinder.

8. The ink removal method for a printing press as claimed in claim 7, further comprising:

bringing said ink form rollers into a throw-off state relative to said plate cylinder in a printing cylinder ON state in which a printing cylinder is in contact with said plate cylinder, thus making printing possible, and in an ink ductor roller OFF state in which ink cannot be supplied to a plate surface of said plate cylinder, before separating said dampening form roller from said plate cylinder in a printing cylinder OFF state in which the printing cylinder is out of contact with said plate cylinder, thus making printing impossible, and in the ink ductor roller OFF state in which ink cannot be supplied to the plate surface of said plate cylinder.

9. The ink removal method for a printing press as claimed in claim 6, further comprising:

a printing make-ready step executed after said plate surface regeneration step, said printing make-ready step including, bringing said dampening form roller into a throw-on state relative to said roller group of said dampening unit and said plate cylinder, bringing said ink form rollers into a throw-on state relative to said plate cylinder, contacting a printing cylinder with said plate cylinder to provide a printing cylinder ON state in which printing is possible, and providing an ink ductor roller ON state in which ink can be supplied to a plate surface of said plate cylinder.

10. The ink removal method for a printing press as claimed in claim 9, further comprising:

bringing said dampening form roller into the throw-on state relative to said roller group of said dampening unit and said plate cylinder; and bringing said ink form rollers into the throw-on state relative to said plate cylinder, in a printing cylinder OFF state in which the printing cylinder is out of contact with said plate cylinder, thus making printing impossible, and in an ink ductor roller OFF state in which ink cannot be supplied to the plate surface of said plate cylinder.

11. The ink removal method for a printing press as claimed in claim 6, wherein said plate surface regeneration step is executed in a printing cylinder OFF state in which a printing cylinder is out of contact with said plate cylinder, thus making printing impossible, and in an ink ductor roller OFF state in which ink cannot be supplied to a plate surface of said plate cylinder.

12. The ink removal method for a printing press as claimed in claim 2, comprising:

a printing make-ready executed step after said ink regeneration step, said printing make-ready step including, bringing said dampening form roller into a throw-on state relative to said roller group of said dampening unit and said plate cylinder, bringing said ink form rollers into a throw-on state relative to said plate cylinder, contacting a printing cylinder with said plate cylinder to provide a printing cylinder ON state in which printing is possible, and providing an ink ductor roller ON state in which ink can be supplied to a plate surface of said plate cylinder.

13. The ink removal method for a printing press as claimed in claim 12, further comprising:

bringing said dampening form roller into the throw-on state relative to said roller group of said dampening unit and said plate cylinder; and bringing said ink form rollers into the throw-on state relative to said plate cylinder, in a printing cylinder OFF state in which the printing cylinder is out of contact with said plate cylinder, thus making printing impossible, and in an ink ductor roller OFF state in which ink cannot be supplied to the plate surface of said plate cylinder.

14. The ink removal method for a printing press as claimed in claim 2, further comprising:

printing after said ink regeneration step; and reducing ink when stopping the printing press, wherein ink reduction step includes bringing said ink form rollers into a throw-off state relative to said plate cylinder before separating said dampening form roller from said plate cylinder.

15. The ink removal method for a printing press as claimed in claim 14, further comprising:

bringing said ink form rollers into a throw-off state relative to said plate cylinder in a printing cylinder ON state in which a printing cylinder is in contact with said plate cylinder, thus making printing possible, and in an ink ductor roller OFF state in which ink cannot be supplied to a plate surface of said plate cylinder, before separating said dampening form roller from said plate cylinder in a printing cylinder OFF state in which the printing cylinder is out of contact with said plate cylinder, thus making printing impossible, and in the ink ductor roller OFF state in which ink cannot be supplied to the plate surface of said plate cylinder.

16. An ink removal method for a printing press, comprising:

providing a form dampening roller and an ink form roller with no roller in contact with both the form dampening roller and the ink form roller;

bringing said ink form roller and said dampening form roller into a throw-on state relative to a plate cylinder; and bringing said dampening form roller into a throw-off state relative to a roller group of a dampening unit.

* * * * *